United States Patent [19]

Andres

[11] Patent Number: 4,540,127

[45] Date of Patent: Sep. 10, 1985

[54] METHOD AND APPARATUS FOR CRUSHING MATERIALS SUCH AS MINERALS

[76] Inventor: Uri Andres, Imperial College of Science & Technology, Department of Mineral Resources Engineering, Royal School of Mines, London SW7 2BP, England

[21] Appl. No.: 496,999

[22] Filed: May 23, 1983

[30] Foreign Application Priority Data

May 21, 1982 [GB] United Kingdom ..... 8214926

[51] Int. Cl.[3] ..... B02C 19/18

[52] U.S. Cl. ..... 241/1; 241/301

[58] Field of Search ..... 241/24, 73, 1, 301, 241/16, 14, 21, 46 R

[56] References Cited

U.S. PATENT DOCUMENTS 4,313,573 2/1982 Goldberger et al. ..... 241/1

FOREIGN PATENT DOCUMENTS 1341851 9/1963 France ..... 241/1

874183 10/1981 U.S.S.R. ..... 241/1

*Primary Examiner*—Mark Rosenbaum

*Attorney, Agent, or Firm*—Cushman, Darby & Cushman

[57] ABSTRACT

Lumps of a mineral or like material comprising two or more solid phases at least one of which is electrically semi-conductive and of different conductivity and permittivity from the other or others are subjected while immersed in water or other high dielectric medium, to the action of an electrical discharge of high enough potential to ionize the mineral. The discharge so generated crushes the lump. The electrodes between which the discharge occurs are so arranged that the discharge is substantially wholly dissipated in the lump. The invention is especially useful for freeing diamond from kimberlite.

9 Claims, 1 Drawing Figure

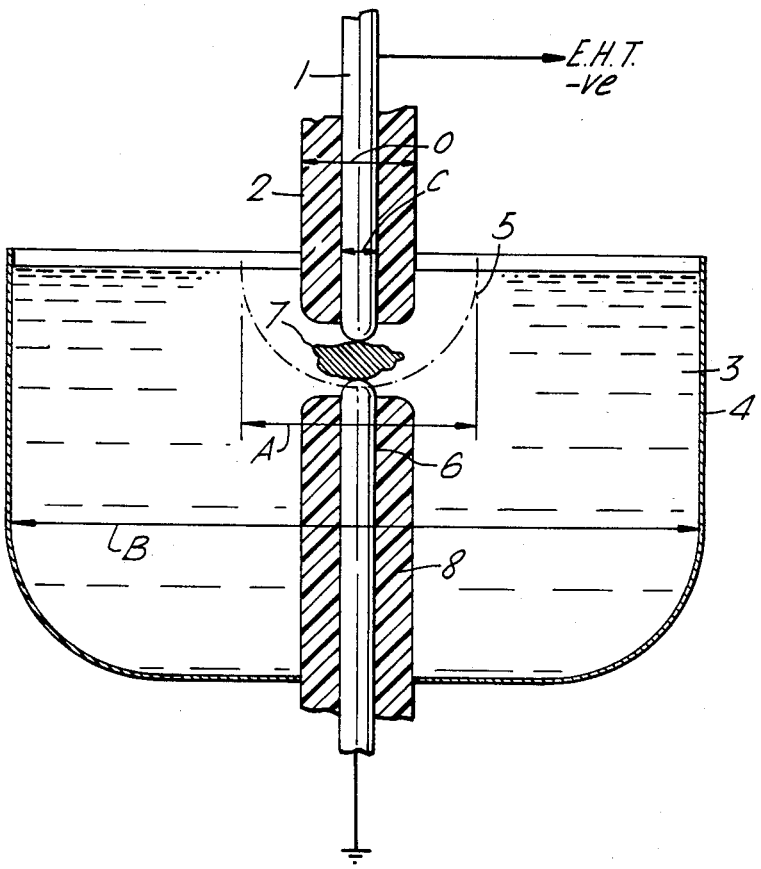
E.H.T.
-ve
1
0
2
C
5
7
3
4
A
6
$L_B$
8

METHOD AND APPARATUS FOR CRUSHING MATERIALS SUCH AS MINERALS

This invention relates to the crushing of materials such as minerals comprising two or more solid phases, at least one of which has electrically semiconductive properties.

The present inventor has described (Andres, International Journal of Mineral Processing 4 (1977) pages 33–38) a method of disintegrating ores by passing electrical discharges therethrough while the ore is immersed in water or transformer oil. The passage of the electrical discharge through the ore causes it to break up, and the disintegration mainly occurs along surfaces of least electrical resistivity and mechanical cohesion, which in practice often coincide with mineral phase boundaries in the ore. This causes the ore to be largely broken up into monomineral grains, and to a greater extent than with purely mechanical processes of disintegrating minerals operating by compression or impact. The process described in the paper differs from other known processes for disintegrating minerals by means of an electrical discharge in that the electrical discharge passes directly through the mineral itself. In the other methods, the electrical discharge passes through the liquid medium in which the mineral is immersed, and the break up of the latter is caused by the shock waves produced in the liquid medium. An important advantage of this difference is that the process in which the electrical discharge passes through the mineral itself can be operated in a vessel, e.g. of a plastics material, which need not be designed to withstand high pressures and avoids the wear of the mechanical elements contacting the rock which are necessarily used in any method of compression or impact crushing.

Adaptation of this process to the technology of commercial crushing of larger (e.g. 10 cm) mineral lumps, however, presents considerable technical problems. In particular, simply increasing the applied voltage and energy so as to maintain the same potential gradient and energy flow in the lump does not give satisfactory results.

It has now been found that the process described in the paper may be substantially improved so as to make possible the crushing of much larger ore lumps, and with a greater disintegrating efficiency than was previously possible. Study of the process has shown that the manner in which the potential gradient is applied to lump is of great importance. More particularly it is necessary to ensure that the electrical discharge is confined substantially entirely in the lump to be crushed. This result may be secured by a combination of two features. In the first place, the lump must be immersed in a liquid medium which has a substantially higher dielectric constant (permittivity) and higher breakdown potential than the solid lump. Second the electrodes used to apply the electric field must be immersed in the medium and very effectively insulated to prevent leakage of current by any path other than through the lump itself. It is not however always necessary for the electrodes to be in actual electrical contact with the lump since a small separation does not prevent the desired discharge, and is technologically convenient if the process is operated continuously.

The present invention accordingly provides a process for crushing a lump of a material such as a mineral comprising two or more solid phases at least one of which is semi-conductive and of different conductivity and permittivity from the other or others which comprises subjecting the said lump, immersed in an inert dielectric medium having a substantially higher dielectric constant and higher electrical breakdown potential than the said lump, to the action of an electrical field of high enough potential to ionize at least one phase of the said lump so that an electrical discharge is caused to pass through the said lump, the said field and discharge being localized substantially entirely in the said lump whereby the said lump is crushed. The process is especially useful for crushing minerals in which at least one of the mineral phases is both economically valuable and substantially non-conductive electrically.

Apparatus according to the invention comprises a vessel for holding an inert liquid dielectric medium having a higher dielectric constant and higher electrical breakdown potential than the material to be crushed, two spaced electrodes, means for establishing a potential between the electrodes sufficient to ionize a lump of material placed therebetween, and means for maintaining the lump between the electrodes and immersed in the medium while an electrical discharge is passed through the lump, the size of the vessel and the arrangement and degree of electrical insulation of the electrodes being such that substantially all the electrical discharge passes through the lump.

The electrical discharge may be brought about by discharging a bank of capacitors across the gap between the electrodes. A pulse generator, e.g. of the Marx type, may be used for this purpose. The voltage generated must be high enough to ionize the lump between the electrodes. A potential of at least 20 kV, and preferably 200 to 800 kV, e.g. about 300 kV, may be used in practice with lumps of mineral weighing up to about 8–10 kg each, the gap between the electrodes being, for example, 1 to 20 cm, and usually about 10–20 cm.

The arrangement of the electrodes between which the electrical discharge is made is fundamental to the improvements obtained by the present invention. The electrode at earth potential is preferably vertically below the electrode to which the high voltage, preferably negative in relation to earth potential, is applied. With this arrangement, the mineral lumps to be broken up may rest upon the lower electrode, and this assists in concentrating the energy of the electrical discharge within the mineral lump. The upper electrode to which the high voltage is applied may conveniently be in the form of a cylinder with a hemispherical end facing the earthed electrode. Only the tips of the electrodes are exposed, the remainder being, to prevent loss of energy by unwanted discharges, and for reasons of safety, provided with a substantial insulating covering. Typically the electrodes are 8 to 20 mm in diameter, and have hemispherical, flat or conical tips.

In some cases it can be advantageous to generate the discharge between electrodes of different sizes, i.e. surface areas, and especially between a small electrode, usually the earthed lower electrode, and a substantially larger electrode, to which the high voltage is normally applied. With this arrangement, the larger electrode may have a diameter 2 to 10 times that of the smaller electrode, e.g. if the smaller electrode is 8 to 10 mm in diameter, the larger electrode may be about 30 mm in diameter.

The high voltage electrode is energised by a pulse generator which be operated to give repeated pulses separated by a period of, for example, a ½ to 10 seconds.

About one pulse per second is preferred. The duration of each pulse is preferably very short, e.g. of the order of a few nanoseconds to several milliseconds.

When the potential is applied the first effect is to cause ionization in the lump. At this stage the current is essentially zero, but after 1–5 nanoseconds as ionization progresses the current rapidly rises to a maximum which may be as high as 15 kA. The discharge, which may last 50 nanoseconds in all, generates a shock wave in the lump which crushes it.

The disintegration is brought about by mechanical failure of the solid lump as a result of tensile stresses, rising from reflection of outward running compressive waves from the liquid-solid interface and from each discontinuity in the acoustic impedance (i.e. cracks or different mineral phase inclusions). Such waves return inward as tensile stress waves. Tensile stresses open existing discontinuities rather than produce new ones. So the disintegration is much less damaging than with compressive mechanical crushing.

The mineral to be crushed comprises a plurality of solid phases having different electrical conductivities and permittivities. Overall, the conductivity of the mineral must be in the semiconductor range since the method is not operable with metals and other materials of metallic conductivity. Equally, the method cannot be used with completely nonconductive materials having very high electrical breakdown potentials.

In practice, however, a very wide range of minerals can be crushed by the new process. The latter is particularly interesting in connection with minerals which contain valuable inclusions of essentially nonconductive materials in a semiconductive matrix of less valuable mineral. In such a case, the tendency of the mineral lump to break along the phase boundaries is enhanced in relation to the boundary between the valuable mineral and the matrix, thus facilitating separation of the valuable non-conductive material from the less valuable semiconductive material. This state of affairs applies in connection with the mineral kimberlite which, as is well known, may contain inclusions of diamond. Kimberlite is semiconductive, but the diamond inclusions are highly resistive. It is a disadvantage of current methods of liberation of diamonds from kimberlite that they may cause damage to the diamonds. The new method substantially reduces this risk and thereby leads to increased liberation of larger size diamonds. Other minerals which can be comminuted include pegmatite containing inclusions of emerald, ruby or sapphire, and granites.

The liquid medium in which the mineral lumps are immersed during disintegration may be any inert liquid dielectric which does not react with the electrodes or the mineral itself and which has a higher permittivity and electrical breakdown potential than the mineral lump. Water of ordinary mains quality satisfies these conditions without special purification and is cheap and convenient to use, but other liquids are in principle usable and may be preferable in some cases, e.g. to avoid chemical interaction.

In a preferred manner of operating the new process, the lump or lumps to be crushed is retained in the gap between the electrodes while means are provided for removing crushed product.

The process may conveniently be operated in an apparatus of the kind shown diagrammatically in the single FIGURE of the accompanying drawings.

In this apparatus, the high voltage electrode 1 is connected to a pulse generator (not shown) providing pulses of about 300 kV at the rate of about one pulse per second of 100 nanosecond duration. The high voltage electrode 1 is shielded except at its tip by a thick insulating sheath 2, e.g. of a cured epoxy resin, glass, porcelain, or another ceramic. The electrode is immersed in a liquid medium, e.g. water, 3 in a vessel 4. The lump of rock to be crushed 7 is retained inside a screen 5 made of a plastics material. In the bottom of the screen 5 an earthed electrode 6 shielded by insulation 8 is placed. In use, the electrical discharge from the high voltage electrode passes through the rock 7. In the drawing the electrodes 1 and 6 are shown as touching the lump 7 but this is not essential. When the lump has been disintegrated to the desired degree, the small particles fall through the perforations in the screen 5 into the bottom of the vessel 4. Means (not shown) may be provided to shake the screen 5 and help cause the small particles to fall through the perforations in the screen 5.

In order substantially to prevent any of the electrical discharge passing through the ambient air, the diameter of the vessel 4 is made large in relation to the diameter of the high voltage electrode. The dimensions denoted A, B, C and D in the drawing may thus typically be as follows. The diameter of the screen indicated as A is about 500 mm. The diameter of the vessel indicated as B may be 700 mm. The diameter of the high voltage electrode indicated as C may be 10–20 mm while the overall diameter of the electrode D including insulation may be 50–70 mm. The largest dimension of the mineral lump 7 may be about 200 mm. The earthed electrode 6 may also have a diameter of 10–20 mm. and an overall diameter including insulation of 50–70 mm. These figures are appropriately related, but some variation in them is obviously possible without interfering with the essential manner of operation of the new process.

Alternatively, as already indicated, in some cases it may be preferred for the earthed electrode 6 to have a diameter of 8–10 mm and the high voltage electrode 1 to have a diameter of about 30 mm, the thickness of the insulation being the same.

As already indicated, the size of the perforations in the perforated screen 5 must be such as to allow comminuted particles of the mineral having the desired size to fall therethrough and collect in the bottom of the vessel 4. Holes of about 1 cm in diameter are appropriate. Other means may of course be provided for continual removal of small mineral fragments from the vessel 4 and for feeding rock lumps into the gap between the electrodes.

While the apparatus shown in the drawing includes only a single pair of electrodes, it is within the scope of the invention to provide a plurality of electrodes conforming to the requirements set out above in order to increase the rate at which the lumps of rock may be crushed by the new process.

I claim:

1. A process for crushing a lump of a material comprising at least two solid phases at least one of which is semi-conductive and of a different conductivity and permitivity to any other phase, which process comprises subjecting the lump immersed in an inert dielectric medium having a substantially higher dielectric constant and higher electric breakdown potential than the lump to the action of an electrical field of a potential between 200 and 800 kV between a pair of opposed electrodes to ionize at least one phase of the lump so that an electrical discharge is caused to pass through the lump, the field and discharge being localized substantially in the lump whereby the lump is crushed.

2. The process claimed in claim 1 in which the gap between the electrodes is at most 200 mm.

3. A process according to claim 1, in which the medium is water.

4. A process according to claim 1, in which the said discharge is generated between electrodes of different sizes.

5. A process according to claim 1, in which the said discharge is generated between a smaller earthed electrode and a substantially larger electrode to which a high voltage is applied.

6. A process according to claim 1, in which one electrode is at earth potential and the other electrode is vertically above the lower electrodes and has a high negative voltage applied thereto.

7. A process according to claim 1, in which the electrical discharge is applied as a series of pulses separated by a period of a $\frac{1}{2}$ to 10 seconds.

8. A process according to claim 1, in which the material to be comminuted is a mineral.

9. A process according to claim 8, in which the mineral is Kimberlite.

* * * * *